United States Patent [19]

Orlens et al.

[11] 3,986,593

[45] Oct. 19, 1976

[54] SNAP-ACTION FASTENER ASSEMBLY

[75] Inventors: Alfreds Orlens, Old Greenwich; Herbert Tramposch, Riverside, both of Conn.

[73] Assignee: Pitney-Bowes, Inc., Stamford, Conn.

[22] Filed: May 14, 1975

[21] Appl. No.: 577,325

[52] U.S. Cl. ..... 197/53; 197/18

[51] Int. Cl.[2] ..... B41J 1/24

[58] Field of Search ..... 197/18, 52, 53, 54, 24/1Q, 197/6.7; 101/93.18, 93.19

[56] References Cited

UNITED STATES PATENTS

| | | | |
|---|---|---|---|
| 3,272,301 | 9/1966 | Craig | 197/6.7 |
| 3,481,211 | 12/1969 | Bottazzi | 197/6.7 X |
| 3,878,929 | 4/1975 | Orlens et al. | 197/1 B X |

OTHER PUBLICATIONS

Mathews, "Spherical Type Element Holding Device," IBM Tech. Discl. Bull., vol. 13, No. 1, June 1970.

*Primary Examiner*—Ralph T. Rader
*Attorney, Agent, or Firm*—William D. Soltow, Jr.; Albert W. Scribner; Robert S. Salzman

[57] ABSTRACT

A snap-action fastener assembly is disclosed, which provides ease of assembly and disassembly of a print disc to and from a serial printer. The snap-action fastener assembly comprises a necked shaft connected to the serial printer, and a pair of flexing jaws connected to the print disc. When pressure is applied about the jaws, they are caused to widen so as to easily slip over the shaft. When the pressure is released, the jaws snap back to a locked position. When the jaws are positioned about the necked section of the shaft in a pressure released condition, the print disc will be securely locked upon the shaft.

1 Claim, 5 Drawing Figures

SNAP-ACTION FASTENER ASSEMBLY

This invention pertains to snap-action fastener assemblies, and more particularly to a snap-action fastener assembly for assembling and disassembling a print disc to a shaft of a serial printer.

BACKGROUND OF THE INVENTION

In print disc serial printing devices, it is advantageous to be able to quickly assemble and disassemble the print disc from the serial printing device. This is so, because different type discs can be used to provide a rapid change of lettering characteristics. In other words, technical reports would require a print disc containing mathematical type notations and symbols, whereas a business letter would require an ordinary alphabetical type disc. The rapid change of type discs provides that the same serial printing device, can be used to provide a full range of typing needs.

SUMMARY OF THE INVENTION

The invention relates to a snap-action assembly for assembling and disassembling a print disc to and from a serial printing machine. The snap-action assembly comprises a shaft having a necked section about a mid-portion thereof. The shaft is connected to the serial printing device. A print disc is pushed onto the shaft for assembly purposes, and contains a pair of movable jaws, which snap into the necked section of the shaft. The movable jaws are caused to move by means of a pair of flexible support members integrally connected between the jaws and the print disc. When the print disc is to be removed, pressure is applied about the jaw members causing the support members to flex. This pressure separates the jaws, thus freeing the print disc from the shaft.

The jaw members comprise an upper and lower jaw member, each member having an arcuate jaw surface engaging with the necked section of the shaft. The pair of flexible support members comprise an upper and lower support member. The upper jaw member is carried by the lower support member, and the lower jaw member is carried by the upper support member. Thus, an inward pressure upon the pair of supports will cause the jaw members to separate.

It is an object of this invention to provide an improved snap-action assembly for assembling and disassembling a print disc to and from a serial printing device;

It is another object of the invention to provide a snap-action assembly for a print disc serial printer, which allows for rapid assembly and disassembly of the print disc from the serial printing machine.

These and other objects of this invention will be better understood, and become more apparent with reference to the following detailed description taken in conjunction with the attached drawings, in which.

DETAILED DESCRIPTION

Generally speaking, the invention is for a snap-action assembly for a print disc serial printer. The assembly comprises a shaft having a necked section in a mid-portion thereof. A snap-action fastener which is carried by a print disc, has movable jaw members that lock about the necked section of the shaft. Flexible support members movably support the jaw members. The jaw members surround the neck section in a locked position when the support members are in an unflexed condition, and are in a separated unlocked position when the support members are flexed. Thus, the print disc can be easily assembled to, and disassembled from the shaft.

Figure 1:
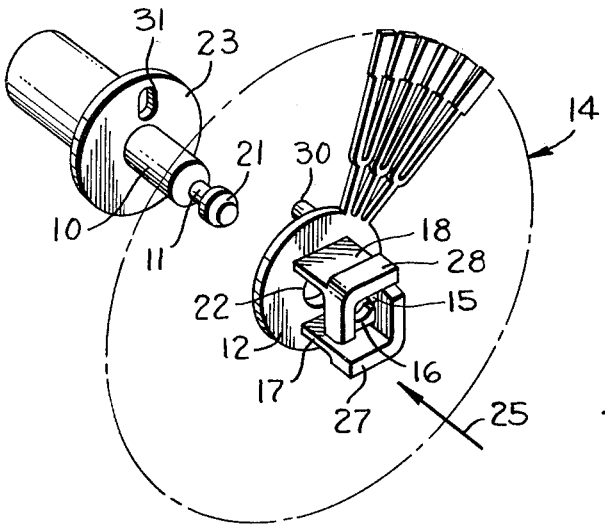
FIG. 1 is an exploded perspective view of the snap-action assembly of this invention.

Now referring to FIG. 1, the snap-action fastener assembly of the invention is shown in an exploded perspective view.

Figure 2:
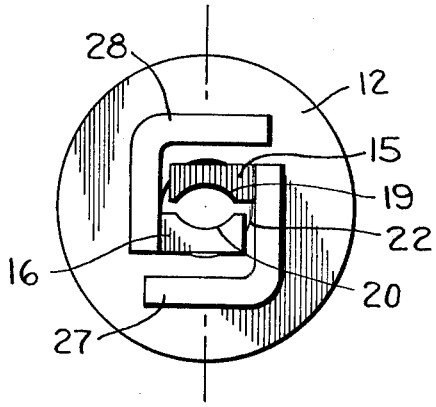
FIG. 2 is a front view of the print disc portion of the snap-action assembly of FIG. 1, shown in a closed position.

A shaft 10 is illustrated having a necked section 11. This shaft is connected to the character selector mechanism of a serial printer (not shown). A print disc 14 (partial view) has a hub section 12 containing a snap-action fastener comprising jaw elements 15, 16 and support members 17 and 18. Jaw elements 15 and 16 are a pair of gripping jaw members having respective arcuate gripping surfaces 19 and 20 (FIG. 2). These surfaces 19 and 20, respectively, clamp about the necked section 11 of shaft 10, as the print disc 14 is caused to be pushed (arrow 25, FIGS. 1 and 4) onto shaft 10.

Figure 4:
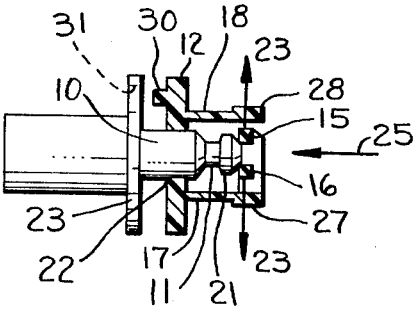
FIG. 4 is a sectional side view of the snap-action assembly of FIG. 1 depicted prior to assembly.

Shaft 10 has a ball-shaped nose 21, which fits through the hole 22 of the hub 12 of the disc 14. The ball-shaped nose 21 causes the jaw members 15 and 16 to separate in the direction of arrows 23 (FIG. 4). As print disc 14 is pushed forward (arrow 25) over the shaft 10, jaws 15 and 16, respectively, ride over the ball-shaped nose 21 and snap into the necked section 11 of the shaft.

The disc 14 will be prevented from over-riding the necked section 11, by means of the disc 23 extending from shaft 10. The disc 23 limits the hub 12 of the disc 14 such that jaws 15 and 16 are centered directly over the necked section 11.

The jaws 15 and 16 are movable by means of the aforementioned flexible support members 17 and 18, respectively.

The upper jaw 15 is supported by the lower support member 17, and the lower jaw 16 is supported by the upper support member 18.

Figure 3:
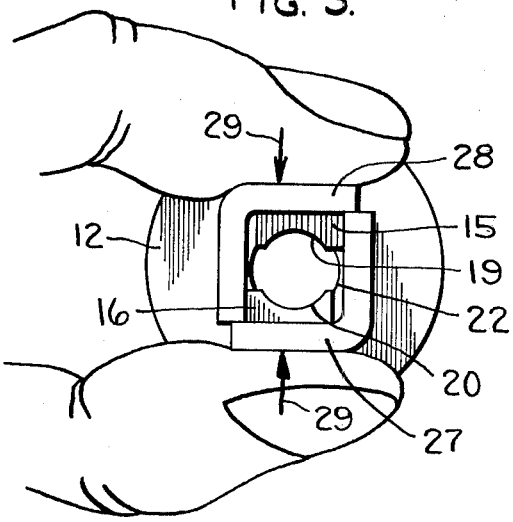
FIG. 3 is a front view of the print disc portion of the snap-action assembly of FIG. 1, shown in an open position.

The ends of the support members 17 and 18, have raised surfaces 27 and 28, respectively. These raised surfaces are easily gripped between one's fingers (see FIG. 3). If pressure is applied to support members 17 and 18 by pressing the raised surfaces 27 and 28 inward (arrows 29), then the jaws 15 and 16 will separate as shown in FIG. 3. This will happen because the jaws are oppositely supported by support members 17 and 18.

To remove the print disc 14 from shaft 10, the surfaces 27 and 28 are squeezed inward (arrow 29, FIG. 3), and the disc is pulled away from the shaft 10 (opposite in direction to arrow 25; FIGS. 1 and 4).

Figure 5:
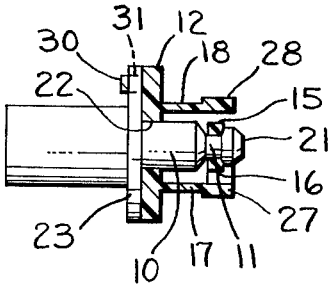
FIG. 5 is a sectional side view of the snap-action assembly of FIG. 1, depicted in the assembled condition.

In order to locate the print disc 14 with respect to shaft 10, a key 30 is provided on hub 12. This key fits into the keyway 31 located on the shaft disc 23 (see FIGS. 1, 4, and 5). The key 30 and keyway 31 also prevent the print disc 14 to rotate with respect to shaft 10.

The support members 17 and 18 can be integrally molded with the print disc 14, and therefore, be part of the hub 12, or they can be attached separately to the hub 12. The support members 17 and 18 can be molded from a flexible "memory-type" plastic, so that they always spring back to their original non-flexed condition.

Naturally, many modifications and changes may occur to the skilled practitioner in this art.

Such obvious changes are deemed to be included in the spirit and scope of the invention as presented by the appended claims.

What is claimed is:

1. A snap-action fastener assembly for a print disc serial printer, comprising a rotative cylindrical shaft connected to said serial printer for indexing and receiving a print disc, said shaft having a ball-shaped nose and a necked section in a mid-portion thereof for receiving a pair of jaw members of a snap-action fastener supported by the print disc, said pair of jaw members each having an arcuate engaging surface which conforms to the necked section of said shaft, said jaw members comprising an upper and a lower jaw member, said jaw members being supported by a pair of flexible support members comprising an upper and a lower support member each having a pressure receiving surface, the upper jaw member being carried by the lower flexible support member, and the lower jaw member being carried by the upper flexible support member, said flexible support members being of integral construction with said print disc, said jaw members being movable as said support members are caused to flex, such that said jaw members will move between a locked position in surrounding relationship about the necked section of the shaft and a separated unlocked position in disengagement with said necked section, said print disc being easily disassembled from said serial printer by applying pressure to said flexible support members to move inwardly such that said jaw members will be caused to move outwardly towards said separated unlocked position such that the print disc is easily disengaged from said shaft, said print disc being easily assembled to said shaft by causing the jaw members to ride over the ball-shaped nose of the shaft and snap into said locked position about the necked portion of said shaft, said shaft further comprising a keyway, and said print disc further comprising a key for insertion into said keyway for securing the print disc at a given position upon said shaft.

* * * * *